United States Patent [19]

Foster et al.

[11] 4,416,707

[45] Nov. 22, 1983

[54] SECONDARY RECRYSTALLIZED ORIENTED LOW-ALLOY IRON

[75] Inventors: Karl Foster, Forest Hills Borough; Gary C. Rauch, Murrysville; Wayne M. Swift, Trafford; Donald R. Thornburg, Forest Hills Borough, all of Pa.

[73] Assignee: Westinghouse Electric Corp., Pittsburgh, Pa.

[21] Appl. No.: 301,543

[22] Filed: Sep. 14, 1981

[51] Int. Cl.[3] ..... H01F 1/04

[52] U.S. Cl. ..... 148/111; 148/120

[58] Field of Search ..... 148/111, 120

[56] References Cited

U.S. PATENT DOCUMENTS

| | | | |
|---|---|---|---|
| 2,867,557 | 1/1959 | Crede et al. | 148/111 |
| 3,287,183 | 11/1966 | Taguchi et al. | 148/111 |
| 3,632,456 | 1/1972 | Sakakura et al. | 148/111 |
| 3,636,579 | 1/1972 | Sakakura et al. | 148/111 |
| 3,855,020 | 12/1974 | Salsgiver et al. | 148/111 |
| 4,115,160 | 9/1978 | Benford et al. | 148/111 |
| 4,157,925 | 6/1979 | Malagari et al. | 148/111 |
| 4,171,994 | 10/1979 | Miller | 148/111 |
| 4,225,366 | 9/1980 | Harase et al. | 148/111 |

*Primary Examiner*—John P. Sheehan

*Attorney, Agent, or Firm*—John J. Prizzi

[57] ABSTRACT

An alloy and a method of making the same are described. This alloy is suitable for use in an electrical magnetic induction apparatus. The alloy is characterized in that it may undergo an $\alpha \rightleftarrows \gamma$ phase transformation upon heating to a sufficiently high temperature and in which the microstructure is oriented in the (110)[001] manner as described by Miller indices and is further characterized by a secondary recrystallized microstructure. The specification is replete with magnetic induction data as well as core loss data for alloys falling within the scope of the invention.

40 Claims, No Drawings

SECONDARY RECRYSTALLIZED ORIENTED LOW-ALLOY IRON

BACKGROUND OF THE INVENTION

The present invention relates to magnetic materials and in particular to an alloy which when fully processed has a major portion of the grains exhibiting a (110)[001] orientation and is characterized by the grains having undergone a secondary recrystallization.

In the past, oriented electrical steels have been characterized usually by the addition of sufficient silicon to close the $\gamma$ loop to such an extent that heating a steel containing 3% silicon with sufficiently low carbon content to a temperature of about 1200° C. resulted in heating said materials in the all $\alpha$ field, the loop having been restricted sufficiently that the alloy would avoid any phase transformation upon heating or cooling to such elevated temperatures.

Commensurate with the addition of 3% silicon to the underlying basic iron was the further factor for the necessity for the control of the manganese and sulfur contents such that a sufficient degree of manganese sulfide was required to be present in the alloy prior to the final high-temperature anneal. During such high-temperature anneal it was the function of the manganese sulfide to inhibit less favorably oriented grains in order to permit the grains having a (110)[001] orientation to grow at the expense of less favorably oriented grains. This occurred during heating of the material to the final high-temperature anneal.

However, once the desired orientation was obtained the sulfur content was no longer needed and, in fact, provided a deleterious effect on the overall magnetic characteristics such that in the commercial manufacture of oriented silicon steels, a sufficiently high temperature was obtained in the final anneal and held for a sufficiently long period of time to dissociate the manganese sulfide into its components and thereby through the use of a dry hydrogen atmosphere, the sulfur content was reduced to acceptably low levels so that the overall combination of magnetic characteristics obtainable in the steel was optimized.

In more recent years a new type of technology has been evolved which employs a different type of inhibitor, namely nitride or certain borides in combination with manganese sulfide utilized in the earlier produced oriented silicon steels. These steels in which the aluminum nitride or other inhibiting element was utilized have been known commercially as the so-called high-B steels. These high-B steels usually had an induction in excess of about 18.8 kilogauss at a magnetizing force of 10 oersted.

One common thread is apparent in these prior art steels and that is that the final heat treatment takes place near 1200° C., a temperature in excess of the $\alpha \rightleftarrows \gamma$ transformation temperature for materials containing, for example, less than about 2.5% silicon. Typical of the prior art in which the aluminum nitride was utilized as the inhibiting agent is U.S. Pat. No. 3,287,183 in the name of Taguchi et al. These inventors find that two cold rolling steps must be critically controlled, the first one being within the limitation of 5 to 40%, and the second one being within the range between 81 and 95% reduction in area. In addition, Taguchi et al. required a definite relationship between the sulfur and the acid soluble aluminum together with an intermediate annealing temperature range, none of which the applicants have found to be critical. In fact, applicants have substantially less sulfur and aluminum than recommended by Taguchi et al. and the temperature of their intermediate anneal is usually in the neighborhood of about 850° C., whereas Taguchi et al. recommends 950° to 1200° C.

Another patnet to Sakakura et al. namely U.S. Pat. No. 3,632,456 describes essentially the same composition of matter and the processing which is fairly similar to Taguchi et al. and differing therefrom by requiring the annealing and quenching of the strip material in order to precipitate aluminum nitride. Sakakura et al. also find it necessary for forming a primary recrystallized microstructure in the steel sheet between cold rolling operations. To substantiate the same effect, more elucidation on the rolling schedules as well as the necessity for the precipitation of the aluminum nitride through a specified heat treatment may be found in U.S. Pat. No. 3,636,579 also in the name of Sakakura, et al.

SUMMARY OF THE INVENTION

In contrast to the prior art practices of utilizing relatively high levels of manganese sulfide and aluminum nitride to inhibit the growth of less favorably oriented grains, it has been found that smaller quantities of sulfur and aluminum can be utilized with lower annealing temperatures and thereby allow lower silicon contents which improve the saturation magnetization without unduly inhibiting the volume resistivity and still obtain the oriented crystallographic structure in a secondary recrystallized microstructure. The lower silicon compositions, that is, less than 2% silicon are such that the material upon heating in excess of about 1050° C. will undergo an $\alpha$ to $\gamma$ transformation. It is believed that where the material undergoes an $\alpha$ to $\gamma$ transformation the volume of crystals which will obtain the desired (110)[001] orientation in the rolling direction will be substantially smaller if the material is heated above the critical transformation temperature. Yet these high temperatures were heretofore believed necessary in order to obtain the desired degree of orientation and removal of the inhibitor impurities as suggested in the prior art teachings employing either manganese sulfide or aluminum nitride. The method of the present invention is also applicable to compositions having a closed gamma loop if the amount of aluminum, nitrogen, manganese and sulfur are controlled within the limits as set forth herein.

In the present invention, the final anneal is at a sufficiently low temperature that the material will not be exposed to a temperature above the critical temperature and yet will exhibit the (100)[001] orientation and a secondary recrystallized microstructure.

The present invention relates to an alloy which has a microstructure characterized by secondary recrystallization. In this respect the alloying components include 0.010% to 0.050% carbon, less than about 3.5% silicon, up to about 2% of a volume resistivity improving element, aluminum 0.005% to 0.015%, manganese 0.03% to 0.30%, nitrogen 0.003% to 0.015%, sulfur 0.003% to 0.012% and the balance iron with incidental impurities. The alloy when fully processed will exhibit a (110)[001] orientation and the alloy will also have a secondary recrystallized microstructure.

After the melt of the desired composition is made, it is thereafter cast and following casting the material is hot-worked preferably with a finishing temperature within the range between about 800° C. and about 1000°

C. Following hot-working the material is cold-worked in one or more operations to finish gauge with an intermediate $\alpha$ phase anneal being interposed between each successive cold-working operation. Finally the material of finish gauge is heated to a temperature below the $\alpha$–$\Gamma$ transformation temperature, preferably within the range between about 850° C. and about 1050° C. for alloys containing less than 2% silicon and 1100° to 1200° C. for higher silicon content alloys. As thus manufactured, the alloy is suitable for use as a core material in electromagnetic inductive apparatus, for example, transformer cores.

DESCRIPTION OF THE PREFERRED EMBODIMENT

The alloy of the present invention may be made in any of the well-known manners for making steel and the preferred method is to melt the components in an electric arc furnace. It, of course, will be understood that such melting procedures as those of a basic oxygen furnace or an induction furnace can also be utilized in manufacturing the alloy of the present invention.

The components in the requisite amounts are melted and preferably while the alloy is in the molten condition it is vacuum-degassed and desulfurized prior to pouring either into a tundish for continuous slab casting or for the pouring of individual ingots.

In order to more clearly demonstrate the present invention reference may be had to TABLE I hereinafter which lists the chemical composition of heats A1, A2 and B.

TABLE I

| Heat* | % Si | % Mn | % S | % C | % Al** | % N | % O |
|---|---|---|---|---|---|---|---|
| A1 | 0.97 | 0.12 | 0.007 | 0.014 | 0.012 | 0.008 | 0.006 |
| A2 | 1.07 | 0.07 | 0.008 | 0.014 | 0.012 | 0.009 | 0.006 |
| B | 0.87 | 0.08 | 0.004 | 0.016 | 0.006 | 0.005 | 0.005 |

*Mill analysis
**Acid soluble aluminum

Heats A1 and A2 were melted in a commercial 150-ton electric arc furnace, vacuum-degassed and desulfurized prior to pouring into a number of ingots. Heat B was melted in a 10-ton electric arc furnace using previously desulfurized iron. This heat was also vacuum-degassed and thereafter was poured into a single ingot. The ingots from these heats were, after solidification, soaked and rolled in a commercial rolling mill. Two ingots from heat A1 were rolled to about 0.175 inch thick hot bands in the mill after the ingots were first slabbed and initially rolled from about 1300° C. One hot band had a finishing temperature of about 950° C. and the other had a finishing temperature of about 840° C. Samples from both hot bands were processed as follows: after pickling, the material was cold rolled to 0.080 inches and thereafter given an intermediate anneal followed by a second cold rolling to a thickness of 0.020 inches, another intermediate anneal and a final cold rolling to finish gauge of a thickness of 0.006 inches. Thereafter the material was given a final box anneal for 48 hours at 900° C. in dry hydrogen.

Under one cold rolling schedule, the hot band material was given a 5 hour box anneal at 850° C. in dry hydrogen prior to cold rolling. In this cold rolling schedule the first intermediate anneal was also a 5 hour box anneal and the second intermediate anneal was a 1 hour box anneal. All intermediate box anneals were performed at approximately 850° C. in dry hydrogen. In the other case, 2 to 3 minute strip intermediate anneals at 900° C. in dry hydrogen were given only between cold rolling stages; there was no anneal prior to cold rolling. All samples as thus processed had essentially complete secondary recrystallization to a (110)[001] orientation after final annealing

TABLE II

| Hot-work Finish Temp. (°C.) | inter. Anneals | $H_c$ (Oe) | $B_{10}$ (kG) | 60 Hz Losses $P_{c15}$ (W/lb) | $P_{c17}$ (W/lb) | $P_{c18}$ (W/lb) | $P_{c19}$ (W/lb) |
|---|---|---|---|---|---|---|---|
| 950 | Box | 0.145 | 19.3 | 0.62 | 0.79 | 0.91 | 1.07 |
| 950 | Strip | 0.162 | 19.2 | 0.63 | 0.80 | 0.92 | 1.09 |
| 840 | Box | 0.140 | 19.9 | 0.60 | 0.74 | 0.82 | 0.94 |
| 840 | Strip | 0.154 | 19.4 | 0.59 | 0.75 | 0.86 | 1.01 |

Reference to TABLE II is made for a comparison for the magnetic characteristics exhibited by the materials after being processed as above described. It should be noted that all of the samples have a high $B_{10}$ value, a low coercive force and the 17 and 18 kilogauss core less values are comparable to commercially produced oriented silicon steel containing a minimum of about 3% silicon.

An ingot from heat A2 was hot rolled in the mill to 0.180 inches from a slab which was heated to a temperature of about 1300° C. and the finishing temperature of the hot-rolling operation was about 1000° C. The coil was rolled thereafter to 0.006 inch final gauge in the mill using the same process as above described with the exception that a 1- to 2-minute intermediate strip anneal at about 880° C. was interposed between each cold-working operation. Thereafter the cold-rolled samples were annealed for about 90 hours in dry hydrogen in a furnace with a gradient from about 850° C. to 1050° C. Extensive secondary recrystallization to the (110)[001] texture was observed in the temperature range between 900° and 950° C.

An ingot from heat B was also slabbed in the mill and the samples were hot rolled so that they had finishing temperatures of about 900° C., 1050° C. and 1200° C. The thickness of the hot rolled material was 0.160 inches. Samples were then cold rolled to 0.006 in using the same process as set forth initially above for heat A1 material with hot anneals being interposed at 850° C. both at the hot-band stage and at all intermediate thicknesses. Thereafter the cold-rolled samples were annealed for 48 hours at 900° C. after the material had been cold worked to its finished gauge thickness. Essentially complete secondary recrystallization was observed in the samples hot rolled at 900° and 1200° C. A smaller grain size, however, was observed in the sample hot rolled so that the finishing temperature was 1050° C.

TABLE III

| Hot Roll Finishing Temp. (°C.) | $H_c$ (Oe) | $B_{10}$ (kG) | 60 Hz Losses $P_{c15}$ (W/lb) | $P_{c17}$ (W/lb) | $P_{c19}$ (W/lb) |
|---|---|---|---|---|---|
| 900 | 0.15 | 19.7 | 0.61 | 0.79 | 1.10 |
| 1050 | 0.18 | 18.5 | 0.62 | 0.85 | — |
| 1200 | 0.15 | 19.7 | 0.62 | 0.81 | 1.12 |

By referring to TABLE III the magnetic characteristics of this latter group of materials is set forth and clearly demonstrates the advantages of the alloy and process of the present invention. Thus, it is seen that good secondary recrystallization textures can be obtained in low alloy iron melted and processed employing commercial facilities. The aluminum and sulfur contents are much lower than required for previously reported processes for obtaining a secondary recrystallized microstructure.

When heat A2 having the chemistry set forth in TABLE I was melted, four of the ingots were inoculated with a nominal addition of 0.6% chromium. The effect of the chromium was sufficiently significant that the alloy without chromium had a resistivity of about 25 microhm-centimeters whereas the ingots in which about 0.6% chromium was added exhibited an improved resistivity of about 28 microhm-centimeters. All four of the chromium-containing ingots were rolled with different hot-rolling parameters to hot-rolled bands as follows:

TABLE IV

| Coil No. | Slab T (°C.) | Finish T (°C.) | Coiling T (°C.) | Gauge (in) |
|---|---|---|---|---|
| 18 | 1320 | 1020 | 700 | 0.161 |
| 19 | 1320 | 850 | 650 | 0.172 |
| 20 | 1160 | 880 | ~660 | 0.178 |
| 21 | 1160 | 850 | 740 | 0.169 |

Samples from all four hot-rolled bands were thereafter rolled to a final thickness of 0.006 inch by the following process: the hot-rolled material was pickled and then annealed for 5 hours at 850° C., cold rolled to 0.080 inch thickness, annealed for 5 hours at 850° C., cold rolled to 0.020 inch annealed for 1 hour at 850° C., cold rolled to 0.006 inches and thereafter tested. All anneals utilized a dry hydrogen atmosphere. Samples from coils numbered 18 and 20 were rolled to a finish thickness of 0.011 inches by the following process: following pickling of the hot-rolled material it was cold rolled to 0.080 inch thickness annealed for 1 hour at 850° C., cold rolled to 0.030 inch thickness annealed 1 hour at 850° C. and finally cold rolled to 0.011 inch finish thickness. Epstein samples from the 6-mil material were annealed 72 hours in dry hydrogen at 925° C. while the 11-mil materials were annealed for 48 hours at 900° C. Essentially complete secondary grain growth was obtained in all samples after these final anneals and reference to TABLE V summarizes the magnetic characteristics exhibited by the alloys.

TABLE V

| Coil No. | Final t (mils) | $H_c$ (Oe) | $B_r$ (kG) | $B_{10}$ (kG) | $P_{c15}$ (W/lb) | $P_{c17}$ (W/lb) | $P_{c18}$ (W/lb) | $P_{c19}$ (W/lb) |
|---|---|---|---|---|---|---|---|---|
| 18 | 6 | 0.135 | 16.9 | 19.2 | 0.54 | 0.68 | 0.79 | 0.93 |
| 18 | 11 | 0.122 | 16.1 | 18.8 | 0.70 | 0.93 | — | — |
| 19 | 6 | 0.138 | 15.4 | 19.1 | 0.56 | 0.72 | 0.84 | 0.99 |
| 20 | 6 | 0.145 | 15.7 | 18.6 | 0.57 | 0.77 | 0.91 | 1.06 |
| 20 | 11 | 0.119 | 15.9 | 18.9 | 0.71 | 0.94 | — | — |
| 21 | 6 | 0.137 | 15.9 | 18.7 | 0.54 | 0.71 | 0.84 | 0.97 |

It should be noted that while the alloys containing chromium have a slightly lower $B_{10}$ value than similar alloys without chromium, the loss characteristics compare quite favorably and with the improved volume resistivity the materials become ideally suited for use as transformer core materials.

An important feature of mill processing conventional grain oriented 3% Si-Fe is the high slab temperature, 1300–1400° C., required for hot rolling to obtain the optimum texture. This high temperature hot rolling increases the final processing cost due to added energy requirements, oxidation losses, and equipment wear. It has been found according to the present invention that good textures can be obtained using slab temperatures as low as 1100 to 1200° C., as well as the conventional 1300° C. Low slab temperatures, such as 1100° and 1200° C., would result in cost savings and allow hot rolling to be done in mills that do not have special high temperature slab heating facilities.

Alloy A2 slabs 9024 and 9014, without chromium additions, were hot rolled in the mill at 1320° and 1160° C., respectively, to a hot band thickness of about 0.180 inches. The final hot band temperature of the slabs rolled at 1320° and 1160° C. were about 1020° and 880° C., respectively, and the coiling temperatures were about 720° and 630° C., respectively. After pickling, samples were rolled in the laboratory by a three stage cold rolling process to a final thickness of 6 or 11 mils using either box or strip intermediate anneals as delineated in Table VI. Alloy B was hot rolled in the mill at 1200° C. to a thickness of about 0.160 inches. This alloy was then cold rolled to final thicknesses of 6 and 11 mils using intermediate box anneals according to the following Table VI.

TABLE VI

COLD ROLLING AND ANNEALING SCHEDULES

Schedule I - Alloy A2 - Box Intermediate Annealed - 6 Mil Final Gauge

| | |
|---|---|
| A. | Box anneal in dry hydrogen at 850° C. for a time at temperature of about 5 hours. Rapidly cool by placing in a cooling chamber containing room temperature dry hydrogen. |
| B. | Cold roll from hot band gauge to about 0.080 inch. |
| C. | Same as A. |
| D. | Cold roll from 0.080 to about 0.020 inch. |
| E. | Same as A except soak time at 850° C. is one hour. |
| F. | Cold roll from 0.020 to about 0.006 inch. |
| G. | Programmed box anneal in dry hydrogen (Final Anneal). Heating and cooling rates of 50° C./hr with a 72 hour soak at 925° C. |

Schedule II - Alloy A2 - Strip Intermediate Anneal 6 Mil Gauge

Same as Schedule I above except that box annealing steps A, C and E have been replaced by strip anneals in dry hydrogen at 825° C. for a time at temperature of about one minute, a heating rate of about 200° C./minute, and a cooling rate of about 80° C./minute.

Schedule III - Alloy A2 and Alloy B - Box Intermediate Annealed - 11 Mil Gauge

| | |
|---|---|
| H. | Cold roll from hot band gauge to 0.080 inches. |
| I. | Box anneal at 850° C. in dry hydrogen for 1 hour at temperature. |
| J. | Cold roll from 0.080 to 0.030 inches. |
| K. | Repeat step I anneal. |
| L. | Cold roll to .011 inches. |
| M. | Programmed box anneal in dry hydrogen (final anneal). Heating and cooling rates of 50° C./hour with a 48 hour soak at 900° C. |

Schedule IV - Alloy B - Box Intermediate Anneal - 6 Mil final Gauge

Same as Schedule I except that final box anneal performed at 900° C. for 48 hours.

Epstein samples having processing histories in accordance with the schedules shown in Table VI exhibited essentially complete secondary recrystallization structures with magnetic properties as shown in Table VII.

TABLE VII

| Alloy/ Slab | Hot Roll Temp. °C. | Cold R Schedule No. | Final Gauge (mils) | $H_c$ (Oe) | $B_{10}$ (kG) | $P_{c15}$ (W/lb) | $P_{c17}$ (W/lb) |
|---|---|---|---|---|---|---|---|
| A2/9024 | 1320 | I | 6 | 0.122 | 19.8 | 0.57 | 0.71 |

TABLE VII-continued

| Alloy/ Slab | Hot Roll Temp. °C. | Cold R Sched- ule No. | Final Gauge (mils) | $H_c$ (Oe) | $B_{10}$ (kG) | $P_{c15}$ (W/lb) | $P_{c17}$ (W/lb) |
|---|---|---|---|---|---|---|---|
| A2/9024 | 1320 | II | 6 | 0.133 | 19.2 | 0.61 | 0.77 |
| A2/9024 | 1320 | III | 11 | 0.123 | 19.1 | 0.74 | 0.97 |
| A2/9014 | 1160 | I | 6 | 0.128 | 19.4 | 0.57 | 0.73 |
| A2/9014 | 1160 | II | 6 | 0.131 | 19.2 | 0.58 | 0.74 |
| A2/9014 | 1160 | III | 11 | 0.120 | 19.2 | 0.73 | 0.93 |
| B/705L 0031 | 1200 | IV | 6 | 0.154 | 19.1 | 0.65 | 0.88 |
| B/705L 0031 | 1200 | III | 11 | 0.136 | 19.4 | 0.79 | 1.03 |

These results demonstrate that A2 alloys hot rolled at 1160° have very similar properties to those rolled at 1320° C.

In further examples of the present invention, alloy A2 slabs were hot rolled at 1100° or 1300° C. to 0.180 inches or 0.090 inches in thickness. An alloy B slab was hot rolled at about 1200° C. to a hot band thickness of 0.180 inches. The hot bands were then cold rolled to 6 or 11 mils by a two stage cold rolling process as shown in Table VIII.

TABLE VIII

TWO STAGE COLD ROLLING AND ANNEALING SCHEDULES

| | |
|---|---|
| | Schedule V 0.090" Rolled to 0.011" Final Size |
| N. | Cold roll to 0.025 inches. |
| O. | Box anneal in dry hydrogen for one hour at 850° C. Rapidly cool by placing in a cooling chamber containing room temperature dry hydrogen. |
| P. | Cold roll to 0.011 inches. |
| Q. | Programmed box anneal in dry hydrogen (final anneal). Heating and cooling rates of 50° C./hour with a 48 hour soak at 950° C. |
| | Schedule VI 0.090" Rolled to 0.006 Final Size |
| | Same as Schedule V with the exceptions that in the first cold rolling step the material is reduced to 0.020 inches and in the second cold rolling step it is reduced to 0.006 inches. The final anneal is performed at 925° C. for 72 hours at temperature. |
| | Schedule VII 0.090" Rolled to 0.006 Final Size |
| R. | Strip anneal in dry hydrogen at 825° C. for about one minute at temperature. Heating rate ~200° C./minute, cooling rate ~80° C./minute. |
| S. | Cold roll to 0.020 inches. |
| T. | Repeat step R. |
| U. | Cold roll to 0.006 inches. |
| V. | Programmed final box anneal as in Schedule VI. |
| | Schedule VIII 0.180" or 0.160" Rolled to 0.011 Final Size |
| W. | Cold roll to 0.080 inches. |
| X. | Box anneal per step O. |
| Y. | Cold roll to 0.011 inches. |
| Z. | Programmed box anneal as in previous schedules with exception that material is held at 900° C. for 48 hours. |

Alloy A2 and B material were processed into Epstein samples using the processes described in Table VIII. Those Epstein samples exhibited complete secondary recrystallization and the magnetic properties shown in Table IX.

TABLE IX

| Alloy | Hot Roll Temp. (° C.) | Hot Band t (mils) | Cold R. Sched- ule No. | Final Gauge (mils) | $H_c$ (Oe) | $B_{10}$ (kG) | $P_{c15}$ (W/lb) | $P_{c17}$ (W/lb) |
|---|---|---|---|---|---|---|---|---|
| A2 | 1300 | 90 | V | 11 | 0.114 | 19.2 | 0.71 | 0.91 |
| A2 | 1300 | 90 | VI | 6 | 0.114 | 19.8 | 0.60 | 0.74 |
| A2 | 1300 | 90 | VII | 6 | 0.118 | 19.6 | 0.61 | 0.76 |
| A2 | 1300 | 180 | VIII | 11 | 0.124 | 19.0 | 0.73 | 0.97 |
| A2 | 1100 | 180 | VIII | 11 | 0.141 | 19.1 | 0.72 | 0.94 |
| B | 1200 | 160 | VIII | 11 | 0.125 | 19.3 | 0.77 | 0.99 |

Generally the textures and magnetic properties are equivalent to those obtained by the three stage cold rolling process according to the present invention.

It thus becomes apparent that the alloy of the present invention will demonstrate a high degree of (110) [001] orientation and a secondary recrystallized microstructure despite the fact that the material may have an open $\gamma$ loop and the employment of significantly lower temperatures for the final annealing treatment. A radical departure has been demonstrated from the heretofore commercial processing of similar materials. Moreover, the process is applicable for both light gauge (0.006") as well as heavy gauge (0.012") materials although at the higher silicon contents, heavy gauges are preferred.

In addition to the preceding alloys studied, two 7000 gm (1"×5"×about 7") laboratory ingots were cast. These ingots contained 3% Si, 0.1% Mn, 0.008% S, 0.015% C, 0.012% Al, 0.012% N. In addition, one ingot contained 1.0% Cr. Sections of these ingots were hot rolled at 900° or 1200° C. to 0.180 inches, pickled, and then cold rolled in a three-stage cold rolling process to a nominal 0.012 final gauge size. Intermediate strip anneals at 850° C. in dry hydrogen were performed between cold rolling stages. The material was then given a final strip anneal at 815° C., coated with MgO+5% $MgSO_4$, followed by a final alpha phase anneal at 1175° C. for 24 hours in dry hydrogen. These materials exhibited substantial secondary recrystallization and a predominantly (110)[001] texture. Coated samples from the alloy without Cr additions and hot rolled at 1200° C. exhibited the following magnetic properties: $B_{10}=17.7$ kG, $P_{c15}=0.58$ W/lb at 60 Hz, and $P_{c17}=0.85$ W/lb at 60 Hz.

Although the invention has been shown in connection with certain specific embodiments, it will be readily apparent to those skilled in the art that various changes in the method steps and compositional limits can be made to suit requirements without departing from the spirit and scope of the invention.

We claim:

1. In the method of producing (110) orientation in silicon-iron alloys having a silicon content less than about 2.5% and in which the alloy may be subject to an $\alpha \rightleftarrows \gamma$ phase transformation, the (110) orientation being characterized by a secondary recrystallization grain structure, the steps comprising, making a melt of the desired composition in which the sulfur content is within the range between 0.003% and 0.012%, the aluminum content is within the range between 0.005% and 0.015%, the nitrogen is between 0.003% and 0.015%, and the manganese is within the range between 0.03% and 0.30% casting the melt into ingots or slabs, hot working the ingots or slabs to a hot band, cold rolling to finish gauge in one or more operations with an intermediate annealing between cold-rolling operations, final annealing at a temperature between about 800° C. and 1050° C. and within the α phase and wherein said final annealing producing said secondary recrystallization grain structure.

2. The method of claim 1 in which the final anneal is a box anneal at a temperature of between about 850° C. and 950° C.

3. The method of claim 1 in which the final anneal is performed at a temperature within the range between about 850° C. and 950° C. for a time period of between about 2 hours and 72 hours.

4. The method of claim 1 further comprising annealing at a temperature within the α phase prior to the first cold rolling operation.

5. The method of claim 1 further comprising strip annealing at a temperature within the α phase subsequent to the last cold rolling operation and prior to the final anneal.

6. The method of claim 1 wherein said intermediate annealing is performed at a temperature within the α phase.

7. The method of claim 1 wherein said hot working comprises heating said ingots or slabs to about 1100° to about 1200° C. and then reducing said ingots or slabs to said hot band by hot rolling.

8. The method of claim 6 wherein said intermediate annealing is performed by strip annealing at a temperature of 750° C. to 900° C.

9. The method according to claim 1 wherein said silicon content is less than about 2%.

10. In the method of producing (110) orientation in silicon-iron alloys having a silicon content less than about 2.5% and in which the alloy is subject to an $\alpha \rightleftarrows \gamma$ phase transformation, the (110) orientation being characterized by a secondary recrystallization grain structure, the steps comprising, making a melt of the desired composition in which the sulfur content is within the range between 0.003% and 0.012%, the aluminum content is within the range between 0.005% and 0.015%, the nitrogen is between 0.003% and 0.015%, and the manganese is within the range between 0.03% and 0.30%, casting the melt into ingots or slabs, hot working the ingots or slabs to a hot band, cold rolling to finish gauge in one or more operations with an intermediate annealing between cold-rolling operations and final annealing at a temperature within the α phase to produce said secondary recrystallization grain structure.

11. The method according to claim 10 wherein said silicon content is less than about 2%.

12. The method according to claim 10 further comprising annealing at a temperature within the α phase prior to the first cold-rolling operation.

13. The method according to claim 10 further comprising strip annealing at a temperature within the α phase subsequent to the last cold rolling operation and prior to the final anneal.

14. The method according to claim 10 wherein said intermediate annealing is performed at a temperature within the α phase.

15. The method according to claim 10 wherein said hot working comprises heating said ingots or slabs to about 1100° to about 1200° C. and then reducing said ingots or slabs to said hot band by hot rolling.

16. The method according to claim 14 wherein said intermediate annealing is performed by strip annealing at a temperature of 750° C. to 900° C.

17. The method according to claim 10 wherein said silicon contact is less than about 2%.

18. In the method of producing (110) orientation in silicon-iron alloys having a silicon content less than about 2.0% and in which the alloy is subject to an $\alpha \rightleftarrows \gamma$ phase transformation, the (110) orientation being characterized by a secondary recrystallization grain structure, the steps comprising, making a melt of the desired composition in which the sulfur content is within the range between 0.003% and less than 0.01%, the aluminum content is within the range between 0.005% and 0.015%, the nitrogen is between 0.003% and 0.015%, and the manganese is within the range between 0.03% and 0.30%, casting the melt into ingots or slabs, hot working the ingots or slabs to a hot band, cold rolling to finish gauge in one or more operations with an intermediate annealing between cold-rolling operations, and final annealing at a temperature within the α phase.

19. The method according to claim 18 wherein said final annealing is at a temperature between about 800° C. and 1050° C.

20. The method according to claim 18 wherein the final anneal is a box anneal at a temperature of between about 850° C. and 950° C.

21. The method according to claim 18 wherein the final anneal is performed at a temperature within the range between about 850° C. and 950° C. for a time period of between about 2 hours and 72 hours.

22. The method of claim 18 further comprising annealing at a temperature within the α phase prior to the first cold-rolling operation.

23. The method of claim 18 further comprising strip annealing at a temperature within the α phase subsequent to the last cold rolling operation and prior to the final anneal.

24. The method according to claim 18 wherein said intermediate annealing is performed at a temperature within the α phase.

25. The method according to claim 18 wherein said hot working comprises heating said ingots or slabs to about 1100 to about 1200° C. and then reducing said ingots or slabs to said hot band by hot rolling.

26. The method of claim 24 wherein said intermediate annealing is performed by strip annealing at a temperature of 750° C. to 900° C.

27. In the method of producing (110) orientation in silicon-iron alloys having a silicon content not in excess of about 3.5% and in which the alloy may be subject to an $\alpha \rightleftarrows \gamma$ phase transformation, the (110) orientation being characterized by a secondary recrystallization grain structure, the steps comprising, making a melt of the desired composition in which the sulfur content is within the range between 0.003% and 0.012%, the aluminum content is within the range between 0.005% and 0.015%, the nitrogen is between 0.003% and 0.15%, and the manganese is within the range between 0.03% and 0.30%, casting the melt into ingots or slabs, hot working the ingots or slabs to a hot band, cold rolling to finish gauge in one or more operations with an intermediate annealing between cold-rolling operations, strip annealing at a temperature within the α phase subsequent to the last cold rolling operation, and prior to final annealing, performing said final annealing at a temperature between about 800° C. and 1050° C. and within the α phase and wherein said final annealing producing said secondary recrystallization grain structure.

28. The method according to claim 27 wherein the final anneal is a box anneal at a temperature of between about 850° C. and 950° C.

29. The method according to claim 27 wherein the final anneal is performed at a temperature within the range between about 850° C. and 950° C. for a time period of between about 2 hours and 72 hours.

30. The method according to claim 27 further comprising annealing at a temperature within the $\alpha$ phase prior to the first cold-rolling operation.

31. The method according to claim 27 wherein said intermediate annealing is performed at a temperature within the $\alpha$ phase.

32. The method according to claim 27 wherein said hot working comprises heating said ingots or slabs to about 1100° to about 1200° C. and then reducing said ingots or slabs to said hot band by hot rolling.

33. The method according to claim 31 wherein said intermediate annealing is performed by strip annealing at a temperature of 750° C. to 900° C.

34. In the method of producing (110) orientation in silicon-iron alloys having a silicon content not in excess of about 3.5% and in which the alloy may be subject to an $\alpha \rightleftarrows \gamma$ phase transformation, the (110) orientation being characterized by a secondary recrystallization grain structure, the steps comprising, making a melt of the desired composition in which the sulfur content is within the range between 0.003% and 0.012%, the aluminum content is within the range between 0.005% and 0.015%, the nitrogen is between 0.003% and 0.015%, and the manganese is within the range between 0.03% and 0.30%, casting the melt into ingots or slabs, hot working the ingots or slabs to a hot band, cold rolling to finish gauge in one or more operations with an intermediate annealing between cold-rolling operations, wherein said intermediate annealing is performed by strip annealing at a temperature of 750° C. to 900° C. and within the $\alpha$ phase, final annealing at a temperature between about 800° C. and 1050° C. and within the $\alpha$ phase, and wherein said final annealing producing said secondary recrystallization grain structure.

35. The method according to claim 34 wherein the final anneal is a box anneal at a temperature of between about 850° to 950° C.

36. The method according to claim 34 wherein the final anneal is performed at a temperature within the range between about 850° C. and 950° C. for a time period of between about 2 hours and 72 hours.

37. The method according to claim 34 further comprising annealing at a temperature within the $\alpha$ phase prior to the first cold rolling operation.

38. The method according to claim 34 further comprising strip annealing at a temperature with the $\alpha$ phase subsequent to the last cold-rolling operation and prior to the final anneal.

39. The method according to claim 34 wherein the said hot working comprises heating said ingots or slabs to about 1100° to about 1200° C. and then reducing said ingots or slabs to said hot band by hot rolling.

40. The method according to claim 34 wherein said silicon content is less than about 2%.

* * * * *